United States Patent [19]

Halstead

[11] Patent Number: 4,794,394

[45] Date of Patent: Dec. 27, 1988

[54] EMERGENCY VEHICLE PROXIMITY WARNING SYSTEM

[76] Inventor: Thomas L. Halstead, 691 N. Sixth St., Showlow, Ariz. 85901

[21] Appl. No.: 93,620

[22] Filed: Sep. 8, 1987

[51] Int. Cl.[4] ..... G08G 1/00

[52] U.S. Cl. ..... 340/902; 340/901; 340/903; 455/228

[58] Field of Search ..... 340/901-906; 455/1, 9, 227-229

[56] References Cited

U.S. PATENT DOCUMENTS

| | | | |
|---|---|---|---|
| 3,233,217 | 2/1966 | Bost . | |
| 3,293,600 | 12/1966 | Gifft . | |
| 3,412,378 | 11/1968 | Thomas | 340/902 |
| 3,532,986 | 10/1970 | Gelushia et al. | 340/902 |
| 3,710,313 | 1/1973 | Kimball . | |
| 3,760,349 | 9/1973 | Keister . | |
| 3,784,970 | 1/1974 | Simpkin . | |
| 3,854,119 | 12/1974 | Friedman . | |
| 4,013,994 | 3/1977 | Ragano . | |
| 4,238,778 | 12/1980 | Ohsumi | 340/903 |
| 4,296,496 | 10/1981 | Sadler | 340/901 |
| 4,403,208 | 9/1983 | Hodgson et al. | 455/228 |

*Primary Examiner*—Donnie L. Crosland
*Attorney, Agent, or Firm*—Don J. Flickinger; Jordan M. Meschkow

[57] ABSTRACT

An emergency vehicle proximity warning system is disclosed which includes a low power transmitter subsystem carried on board an emergency vehicle and a special purpose receiver subsystem carried on board a second vehicle. The transmitter issues a continuous stream of equally timed-spaced pulses. The receiver subsystem detects the reception or non-reception of the pulses and includes a retriggerable multivibrator having an output which assumes a first logic state when the pulses are not present and a second logic state when the pulses are present. A relay coil, which is energized only when the retriggerable multivibrator is in its second logic state, actuates a set of normally closed relay contacts which are connected into the speaker leads of the vehicle's conventional radio to interrupt the connection between the conventional vehicle radio and its speaker system when the pulses from an emergency vehicle are sensed. To provide a very clear indication to the vehicle operator that the emergency vehicle is nearby, one or more lamps and one or more emergency-sound-issuing devices are alternately energized and deenergized so long as the retriggerable multivibrator is in its second logic state to provide a visual and sonic alarm indication. Preferably, an astable multivibrator is coupled to the retriggerable multivibrator such that it is enabled only when the retriggerable multivibrator is in the second logic state to obtain the information for driving the alarm indicators.

1 Claim, 1 Drawing Sheet

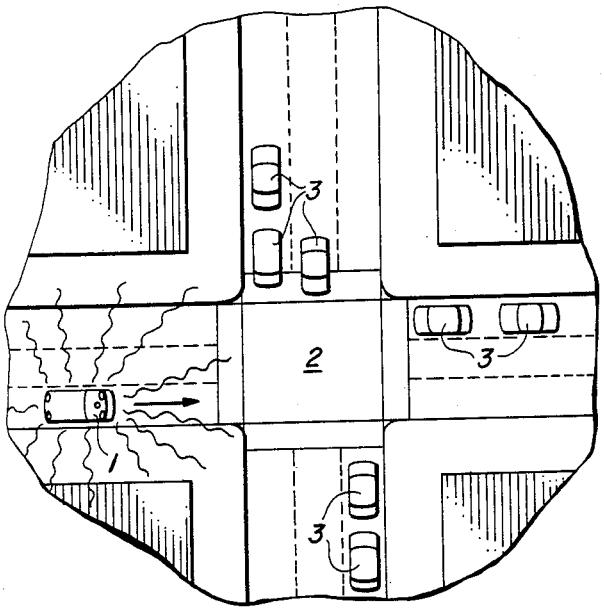
FIG. 1
FIG. 2
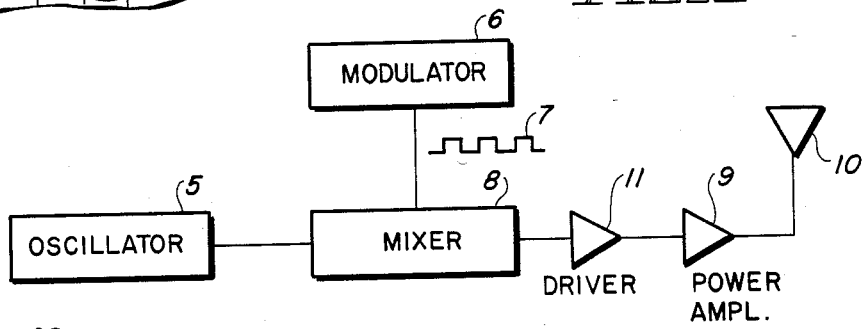
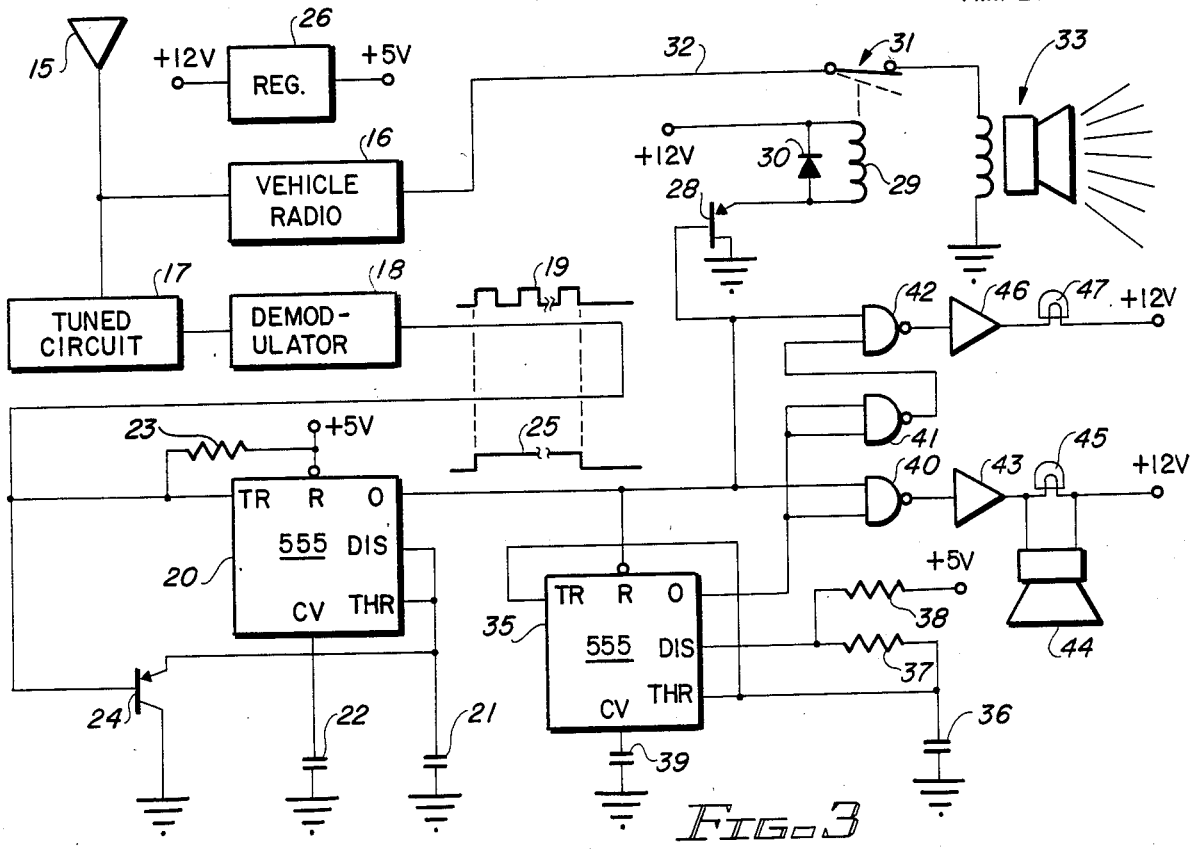
FIG. 3

EMERGENCY VEHICLE PROXIMITY WARNING SYSTEM

FIELD OF THE INVENTION

This invention relates to the art of providing a warning indication to vehicles relatively near an emergency vehicle on call and, more particularly, to the class of such warning systems in which a low power radio frequency signal issued by a transmitter carried in the emergency vehicle is received by receiving systems carried in other vehicles within range.

BACKGROUND OF THE INVENTION

Numerous systems are known in the prior art for providing an indication to vehicle operators that an emergency vehicle on call is nearby in order that the vehicle operators will be prepared for the sudden and unexpected appearance of the emergency vehicle at an intersection or otherwise in the traffic flow. Such systems often employ the broad approach of providing a low powered, special purpose transmitter in the emergency vehicle and suitable receiving equipment adapted to pick up the transmitted signal in the other vehicles if they are within range to provide an alarm indication to the vehicle operators. The present invention falls within this general class and is directed particularly to the provision of a more effective operator alerting technique and apparatus within the receiving vehicles.

OBJECTS OF THE INVENTION

It is therefore a broad object of my invention to provide an improved emergency vehicle proximity warning system.

It is another object of my invention to provide such a system in which a low powered transmitter carried on board an emergency vehicle broadcasts a signal which is received on board a second vehicle in the vicinity, the sensed reception of which activates improved operator warning apparatus within the receiving vehicle.

It is a more specific object of my invention to provide such a system in which there is carried within the receiving vehicle very effective driver-alerting alarm apparatus.

In another aspect, it is an object of my invention to provide such a system in which, to further alert the operator of a receiving vehicle, the conventional vehicle radio is automatically deactivated when the receiving vehicle is within the range of an emergency vehicle transmitting according to the subject system.

SUMMARY OF THE INVENTION

These and other objects of my invention are achieved by an emergency vehicle proximity warning system which includes a transmitter subsystem carried on board an emergency vehicle and a receiver subsystem carried on board a second vehicle, which second vehicle also typically carried on board a conventional vehicle radio. The transmitter subsystem includes an oscillator for establishing the transmitter frequency of operation, a modulator issuing a continuing stream of equally timed-spaced pulses, a mixer for accepting and mixing signals from the oscillator and modulator to develop an output signal of equally time-spaced pulses carried on the oscillator frequency, an output stage for amplifying the output signal, the output stage having a limited power output such that its effective radiation range is correspondingly limited, and a transmitting antenna.

The receiver subsystem carried on board the second vehicle includes a receiving antenna, a tuned circuit coupled to the receiving antenna and tuned to the carrier frequency of the transmitter subsystem, a demodulator coupled to the tuned circuit for detecting the reception or non-reception of the continuous stream of equally time-spaced pulses from teh transmitter subsystem, a retriggerable multivibrator coupled to the demodulator and having an output which assumes a first logic state when the demodulator does not detect the presence of the continuous stream of equally time-spaced pulses and which assumes a second logic state when the modulator does detect the presence of the continuous stream of equally time-spaced pulses and a switch which is responsive to the second logic state to disable the conventional radio carried on board the second vehicle. In a presently preferred embodiment, the switch includes a relay coil which is energized only when the output from the retriggerable multivibrator is in the second logic state and a set of normally closed relay contacts which are connected into the speaker leads of the conventional vehicle radio such that, when the relay coil is energized, the set of contacts if actuated and opens to interrupt the connection between the conventional vehicle radio and its speaker system. To provide a very clear indication to the operator of the second vehicle that the emergency vehicle is nearby, first sensory alerting apparatus, such as one or more lamps, is alternately energized and deenergized so long as the output of the retriggerable multivibrator is in the second logic state to provide a flashing visual alarm indication. Preferably, an astable multivibrator is coupled to the retriggerable multivibrator such that it is enabled only when the retriggerable multivibrator is in the second logic state. Thus, the astable multivibrator, when enabled, issues a continuous string of pulses to drive the lamp circuit alternately on and off. As a still further refinement of the warning system, second sensory altering apparatus including at least one sound issuing device is connected to be alternately turned on and off antiphase with the first sensory alerting apparatus.

BRIEF DESCRIPTION OF THE DRAWINGS

The subject matter of the invention is particularly pointed out and distinctly claimed in the concluding portion of the specification. The invention, however, both as to organization and method of operation, may best be understood by reference to the following description taken in conjunction with the subjoined claims and the accompanying drawing of which:

FIG. 1 is a representation of an exemplary traffic condition in which an emergency vehicle is approaching an intersection which other vehicles are also approaching or preparing to enter;

FIG. 2 is a block diagram of a transmitter subsystem according to the invention and which is carried on board the emergency vehicle; and FIG. 3 is a partially schematic, partially block diagram of a receiver subsystem according to the present invention and which is carried on board a second vehicle.

DETAILED DESCRIPTION OF THE PREFERRED EMBODIMENTS

Referring now to FIG. 1, an emergency vehicle 1 is depicted as approaching an intersection 2 at which other vehicles 3 are also poised to enter. As is notoriously well-known, the situation illustrated in FIG. 1 is potentially dangerous in that most vehicle operators maintain their windows in the closed position in order that the vehicle interior can be air conditioned or heated and also to cut out distracting and unpleasant "traffic noise". In addition, many drivers customarily habitually run their conventional vehicle radio in traffic to pick up news, sporting events, music, to play tapes, etc. As a result, even when, as is customary, an emergency vehicle issues a very loud sonic warning such as a siren, the sonic warning may go unheeded simply because the drivers of nearby vehicles do not hear it. As a result, the emergency vehicle must approach each intersection very carefully, particularly when it must proceed against any stop light or stop sign, and this necessarily cautious approach significantly increases the response time of the emergency vehicle when response time may be critical. It is not unusual for an emergency vehicle to actually be involved in a collison with another vehicle whose driver has not heard the warning sounds issued by the emergency vehicle with the resultant possibility not only of injury to the occupants of the emergency vehicle and the colliding vehicle, but also the danger that the emergency call will not be promptly met.

In the subject warning system, the emergency vehicle 1 is equipped with a low power, special purpose transmitter subsystem, and the other vehicles 3 are each equipped with a special purpose receiver subsystem. While emergency vehicle proximity warning systems of this broad class are well known, it will become apparent from the discussion below that the present system affords a significant advantage over the prior art systems of the class.

Thus, referring now to FIG. 2, the transmitter subsystem carried on board the emergency vehicle is illustrated in block diagram form since it consists of essentially conventional components. An oscillator 5 establishes the carrier frequency of operation for the transmitter system. A modulator 6 issues a continous stream of equally time-spaced pulses as represented by the wave diagram 7. The pulse repetition rate of the signal issued by the modulator 6 (which may be a simple astable multivibrator or the like) will be discussed below. The presently preferred frequency at which the oscillator may be set is on the order of 49 mhz. A mixer 8 accepts signals from both the oscillator 5 and the modulator 6 to develop an output signal of equally time-spaced pulses carried on the oscillator frequency. In practice, the oscillator 5, modulator 6 and mixer 8 can readily be combined in a single integrated circuit such as an LM 1871 with suitable support components.

An output stage 9 accepts and power amplifies the output signal and applies it to a transmitting antenna 10. A driver circuit 11 may be incorporated to buffer the output from the mixer 8 against the input to the power amplifier 9 in the conventional fashion. The output rating of the power amplifier 9 is deliberately limited such that the effective radiation range of the transmitter subsystem is accordingly limited to a predetermined maximum which may be, merely by way of example, on the order of one-quarter mile. Those skilled in the art will therefore understand that the block diagram of FIG. 2 represents a simple, low powered transmitter subsystem continuously issuing equally time-spaced pulses on the carrier, a special purpose signal which can be detected and processed by complementary receiver subsystems carried in other vehicles if they are sufficiently close to the emergency vehicle.

The receiver subsystem is illustrated in FIG. 3. A receiving antenna 15 may be shared by the receiver subsystem with the conventional vehicle radio 16 or may be separately provided as a special purpose antenna. A tuned circuit 17 is employed to isolate the signal, if any, received by the antenna 15 at the emergency vehicle transmitter frequency. The output from the tuned circuit 17 is applied to a conventional demodulator circuit 18 which will issue a stream of equally time-spaced pulses as represented by the wave diagram 19 if the emergency vehicle is within receiving range. Those skilled in the art will appreciate that the tuned circuit 17 andthe demodulator 18 may take diverse conventional forms including superheterodyne and detector circuitry. In practice, these functions can be readily combined in a single integrated circuit such as an LM 1872 with appropriate support components.

The output from the demodulator 18 is coupled to a circuit whose principal component is a integrated circuit timer 20 (which may be the ubiquitous type 555) connected for retriggerable multivibrator operation. The integrated circuit timer 20 is preferably powered from a stable source such as that provided by a 5-volt d-c regulator 26 (which may be a type 7805 or equivalent) powered in turn from the vehicle's 12-volt d-c electrical system. The auxiliary components in the retriggerable circuit include a timing capacitor 21, a stabilizer capacitor 22, a timing resistor 23, and an isolation transistor 24. The output from the demodulator 18 is applied to the trigger input of the integrated circuit timer 20 and also to the base electrode of the transistor 24 which has its collector electrode connected to ground potential. The emitter electrode of the transistor 24 is connected to both the discharge and threshold terminals of the integrated circuit timer 20, the timing capacitor 21 is connected between this same electrical point and ground and the timing capacitor 23 is connected between 5-volts d-c and the trigger input. Those skilled in the art will recognize this configuration as the classical retriggerable multivibrator circuit for the type 555 integrated circuit timer, and the characteristics of this circuit are such that, as long as pulses are applied to the trigger terminal of the integrated circuit timer 20 at a rate which exceeds the ability (established by the timing components) of the circuit to discharge itself, the output will remain "high" (in a second logic state) as indicated by the wave diagram 25 which has been related in FIG. 3 to the wave diagram 19 representing the output from the demodulator 18. Conversely, when the pulses have not yet been received or are no longer received, the output from the integrated circuit timer 20 will remain "low" (in a first logic state). If the timing capacitor 21 is 4.7 microfarads and the timing resistor 23 is 200 ohms, the output from the integrated circuit time will remain in the second logic state so long as pulses are applied to the trigger terminal at a repetition rate that exceeds about 1000 hz; therefore the repetition rate of the pulses generated in the modulator 6 (FIG. 2) should be substantially higher than 1000 hz in order to prevent repeated dropout when the emergency vehicle is within range of the receiving vehicle.

The output from the integrated circuit timer 20, which will be in either the first logic state or the second logic state as noted above, is applied to the base electrode of a transistor 28 which has its collector electrode connected to ground potential. The emitter electrode of the transistor 28 is connected to one end of realy coil 29 which has its other end connected to a source of 12-volt d-c power (such as the vehicle's electrical system). A snubbing diode 30 is disposed across the relay coil 29 to protect the transistor 28 in the conventional fashion.

A set of normally closed relay contacts 31 are actuated by energization of the relay coil 29. The contacts 31 are connected in series with the speaker leads 32 which couple the conventional vehicle radio 16 to its speaker system 33. While only a single channel speaker system is illustrated in FIG. 3, it will be understood that the number of contacts 31 can be expanded to control the delivery of audio power from the conventional vehicle radio 16 to any number of speakers in the speaker system 33.

The result of this interconnection is that the relay coil 29 is energized only when the output from the retriggerable multivibrator is in the second logic state or "high". When this condition is sensed, i.e., when a pulse stream is being received from the transmitter subsystem situated on board an emergency vehicle within range, the relay coil is energized to actuate the contacts 31 and open the connection between the conventional vehicle radio 16 and its speaker system 33, thereby providing a primary indication to the driver that an emergency vehicle is in the vincinity by disabling the radio.

With the radio momentarily disabled, the siren or other audible warning signal issued by the emergency vehicle can usually be heard. If the radio is off, there is no effect, but, again, the audible warning signal can then usually be heard. However, it has been found to be very desirable to add a secondary, and unmistakable, further indication, which is independent of whether the conventional vehicle radio is on or off, to the operator of the second vehicle that an emergency vehicle is nearby. This is achieved by additional circuitry which includes an astable multivibrator (whose principal component may be a second integrated circuit timer 35) and a combination of flashing lights and an emergency-sound-emitting device carried on board the receiving vehicle. The support components to the integrated circuit timer 35 (preferably, again, a type 555) which configure it into the desired astable operation include a timing capacitor 36 and timing resistors 37, 38 with capacitor 39 being employed as a stabilizing capacitor.

In the astable multivibrator configuration for the type 555 integrated circuit timer 35, the threshold terminal is connected to the trigger terminal, the timing capacitor 36 is connected between the threshold terminal and ground, the timing resistor 37 is connected between the discharge and threshold terminals and the timing resistor 38 is connected between the discharge terminal and 5-volts d-c which, as previously mentioned, may be obtained from the regulator 26. Power to the integrated circuit timer 35, however, is obtained directly from the output of the integrated circuit timer 20 of the retriggerable multivibrator stage. Thus, the astable multivibrator will only free run when the output from the integrated circuit timer 20 is at the second logic level of "high" to provide enabling power to the integrated circuit timer 35 of the astable multivibrator. Exemplary values for the timing components of the astable multivibrator are: timing capacitor 36-1.0 microfarad, timing resistor 37-200 kohms and timing resistor 38-50 kohms. Those skilled in the art, by referring to standard nomograms for the type 555 integrated circuit timer, will appreciate that the frequency of operation resulting from these component values is approximately 10 hz. As a result, a more or less symmetrical square wave appears at the output of the integrated circuit timer 35 whenever the prior circuitry has sensed the presence of an emergency vehicle in the area transmitting the pulse stream as previously described.

The output from the integrated circuit timer 35 is applied to one input leg of a first NOR-gate 40 (which has its other input leg connected to the output from the integrated circuit timer 20) and also to both input legs of a second NOR-gate 41 which therefore simply functions as a logic inverter. The output from the inverter 41 is applied to one input leg of a third NOR-gate 42 which also has its second input leg connected to the output of integrated circuit timer 20.

The output of the NOR-gate 42 is coupled, through a driver 46, to one or more lamps as represented by the lamp 47 which has its other terminal connected to 12-volts d-c such that the lamp 47 is illuminated (to provide a first sensory alerting indicator) only when the driver 46 presents a current sinking ground potential to the lamp. In operation, whenever the integrated circuit timer 35 is enabled to free run, the NOR-gates 40 and 42 must also have their second legs already enabled by the output from the first integrated circuit timer 20. The square wave output from the integrated circuit timer 35 is applied, through inverter 41, indirectly to the NOR-gate 42 which is therefore alternatively fully enabled and disabled to correspondingly alternatively energize the first sensory alerting indicator which is disposed in full view of the vehicle operator to obtain a very effective alerting mechanism consisting of flashing light(s).

Similarly, the output from the NOR-gate 40, to which the square wave output from the integrated circuit timer 35 is directly applied, is power amplified through a driver 34 whose output is connected to one terminal of a second sensory alerting indicator which includes at least one emergency-sound-emitting device 44 having its other terminal connected to 12-volts d-c. The emergency-sound-emitting device 44 may be, by way of example, a Sonalert (tm), or other integrated emergency-sound-emitting device which need only be energized to provide a distinctive sonic alert. Optionally, one or more lamps, represented by the lamp 45, may also be energized in unison with the emergency-sound-emitting device 44. Since the emergency-sound-emitting device (and the lamp 45) are energized in antiphase with the lamp 47, the alternately flashing lamps and methodically interrupted sonic alert achieve a remarkable and unmistakable indication to the vehicle operator of the nearby presence of an emergency vehicle.

In summary, when an emergency vehicle carrying on board the transmitter subsystem illustrated in FIG. 2 is sufficiently proximate to activate the receiver subsystem illustrated in FIG. 3 carried in a second vehicle, the conventional radio in the second vehicle is disabled and, simultaneously, a visual and audible sensory alerting indication is activated to unmistakably warn the operator of the second vehicle of the proximity of the emergency vehicle.

Thus, while the principles of the invention have now been made clear in an illustrative embodiment, there will be immediately obvious to those skilled in the art many modifications of structure, arrangements, proportions, the elements, materials, and components, used in the practice of the invention which are particularly adapted for specific environments and operating requirements without departing from those principles.

I claim:

1. An emergency vehicle proximity warning system comprising:

(A) a transmitter subsystem carried on board an emergency vehicle, said transmitter subsystem comprising:
(1) an oscillator for establishing the carrier frequency of operation for the transmitter subsystem, which carrier lies above the broadcast band;
(2) a modulator issuing a continuous stream of equally time-spaced pulses having a repetition rate in excess of 1000 hz;
(3) a mixer for accepting and mixing signals from said oscillator and said modulator to develop an output signal of said equally time-spaced pulses carried on the oscillator frequency;
(4) an output stage for accepting and power amplifying said output signal, said output stage having a limited power output such that its effective radiation range does not exceed a predetermined maximum; and
(5) a transmitting antenna for radiating the amplified output signal issued by said output stage; and (B) a receiver subsystem carried on board a second vehicle, which second vehicle also carries on board a conventional vehicle radio, said receiving system comprising:
(1) a receiving antenna;
(2) a tuned circuit coupled to said receiving antenna and tuned to the carrier frequency of said transmitter subsystem;
(3) a demodulator coupled to said tuned circuit for detecting the reception of the continuous stream of equally time-spaced pulses issued by said modulator;
(4) a retriggerable multivibrator coupled to said demodulator for accepting demodulated signals therefrom, said retriggerable multivibrator including timing components establishing a characteristic response of said retriggerable multivibrator such that:
(a) when said retriggerable multivibrator does not detect the presence of a continuous stream of equally time-spaced pulses having a repetition rate of at least 1000 hz, the output of said retriggerable multivibrator assumes a first logic stage; and
(b) when said retriggerable multivibrator does detect the presence of a continuous stream of equally time-spaced pulses having a repetition rate of at least 1000 hz, the output of said retriggerable multivibrator assumes a second logic state;
(5) switch means responsive to said second logic state to disable the conventional radio carried on board said second vehicle, said switch means comprising:
(a) a relay coil coulped to said retriggerable multivibrator and energized only when said retriggerable multivibrator is in said second logic state; and
(b) a set of normally-closed relay contacts actuated by energization of said relay ocil, said set of normally-closed contacts being connected into speaker leads of the conventional vehicle radio such that, when said relay coil is energized, said set of contacts is actuated and opens to interrupt the connection between the conventional vehicle radio and its speaker system;
(6) an astable multivibrator coupled to said retriggerable multivibrator and enabled only when said retriggerable multivibrator is in said second logic state, said astable multivibrator, when enabled, issuing a continuous string of square wave pulses representing alternating first and second logic levels; and
(7) sensory alerting means responsive to the output from said astable multivibrator being in said first logic state for issuing an alarm indication, said sensory alerting means comprising:
(a) at least one emergency-sound-emitting device, which at least one emergency-sound-emitting device is alternately turned on and off as the output from said astable multivibrator switches between said first and second logic levels; and
(b) at least one lamp, which at least one lamp alternately flashes on and off in unison with said emergency-sound-emitting device being turned on and off as the output from said astable multivibrator switches between said first and second logic levels.

* * * * *